US005318410A

United States Patent [19]

Kawamura et al.

[11] Patent Number: 5,318,410

[45] Date of Patent: Jun. 7, 1994

[54] VARIABLE DISPLACEMENT COMPRESSOR

[75] Inventors: Chuichi Kawamura; Yoshihiro Fujisawa; Masafumi Ito, all of Kariya, Japan

[73] Assignee: Kabushiki Kaisha Toyoda Jidoshokki Seisakusho, Kariya, Japan

[21] Appl. No.: 961,481

[22] Filed: Oct. 15, 1992

[30] Foreign Application Priority Data

Oct. 16, 1991 [JP] Japan ..... 3-267810

[51] Int. Cl.[5] ..... F04B 1/26

[52] U.S. Cl. ..... 417/222.2; 417/270

[58] Field of Search ..... 417/222.1, 222.2, 270

[56] References Cited

U.S. PATENT DOCUMENTS 4,685,866 8/1987 Takenaka et al. ..... 417/222.2
4,723,891 2/1988 Takenaka ..... 417/222.2
4,730,986 3/1988 Kayukawa ..... 417/222.2
4,732,544 3/1988 Kurosawa ..... 417/222.2
4,752,189 6/1988 Bearint ..... 417/222.2
4,780,060 10/1988 Terauchi ..... 417/222.2
4,815,943 3/1989 Kawashima ..... 417/222.2
5,027,612 7/1991 Terauchi ..... 417/222.2
5,071,321 12/1991 Skinner ..... 417/222.2

*Primary Examiner*—Richard A. Bertsch
*Assistant Examiner*—Peter Korytnyk
*Attorney, Agent, or Firm*—Brooks Haidt Haffner & Delahunty

[57] ABSTRACT

An improved wobble plate type variable displacement compressor compressing the refrigerant gas with pistons and discharges the gas from a discharge chamber is disclosed. The piston stroke is adjusted according to the tilt angle of the wobble plate which is varied by the magnitude of the inner pressure of the crank case. The first passage connects a suction chamber to the crank case for transferring the pressure of the crank case to the suction chamber. The second passage connects the crank case to the discharge chamber for transferring the pressure of the discharge chamber to the crank case via a restriction when the difference between the pressures and within the discharge chamber and the crank case is in excess of the predetermined value.

16 Claims, 5 Drawing Sheets

VARIABLE DISPLACEMENT COMPRESSOR

BACKGROUND OF THE INVENTION

1. Field of the Invention

The present invention relates generally to variable displacement compressors. More particularly, the invention relates to an improved mechanism for controlling the inclination angle of the wobble plate according to the pressure difference a crank case and a suction chamber, so as to properly control the compression displacement.

2. Related Art Statement

In conventional variable displacement compressors, a refrigerant gas is sucked into a suction chamber, and is compressed in a cylinder bore. It is then discharged through a discharge port which is formed in a discharge chamber. The compression displacement is controlled by the inclination angle of a wobble plate. The refrigerant gas is also used to adjust the internal pressure in each one of the associated chambers. As the refrigerant gas is discharged into a crank case from the discharge chamber, the internal pressure in the crank case is caused to raise. In contrast, the refrigerant gas in the crank case is discharged into the suction chamber, in order to reduce the internal pressure in the crank case, for de-pressurizing the crank case. The internal pressure in the suction chamber and the crank case act on a piston, which is supported by the wobble plate, and the inclination angle of the wobble plate is caused to vary accordingly. As the pressure in the crank case is caused to rise, the inclination angle of the wobble plate is caused to decrease accordingly, and the compression displacement of the compressor is also decreased. On the other hand, as the internal pressure in the crank case is caused to drop, the inclination angle of the wobble plate is increased, and the compression displacement of the compressor is also increased.

FIG. 7 illustrates such a conventional compressor. In this compressor, a support member 101 is integrally rotatable and secured to a drive shaft 100. An elongated hole 108 is formed in the supporting member 101. The elongated hole 108 serves as a guide for slidably holding a link pin 109. A drive plate 102 is integrally rotated with respect to the support member 101, and is inclined according to the sliding movement of the link pin 109, along the elongated hole 108. A wobble plate 103 is coupled with the drive plate 102. The wobble plate 103 does not rotate synchronously with the drive plate 102, via a stopper 104. As the wobble plate 103 is caused to swing, due to the rotational movement of the drive plate 102, the wobble plate 103 drives a plurality of pistons 105, to reciprocate in the circumferential direction, in order to compress the refrigerant gas.

The internal pressure Pc in the crank case 106 acts on the rear surface of the piston 105, and the internal pressure Ps in the suction chamber 107 acts on the front surface thereof. The force applied on the piston 105 is transmitted to the wobble plate 103, and is then transmitted to the drive plate 102. The link pin 109 is caused to slide along the elongated hole 108 under the force applied on the drive plate 102. Therefore, the inclination angle of the drive plate 102 will be shifted. The inclination angle of the wobble plate 103 is accordingly varied with respect to the difference between the internal pressure on the both chambers 106 and 107. Therefore, the inclination angle of the wobble plate 103, which determines the piston stroke, is set appropriately by controlling the compressed displacement of the compressor.

As illustrated in FIG. 8, a passage 112 interconnects the crank case 106 and the discharge chamber 110. A throttle 111 is disposed in the passage 112, for preventing pressure leakage from the crank case 106 to the discharge chamber 110. Therefore, the internal pressure in the crank case 106 is not allowed to drop suddenly. Consequently, the inclination angle of the wobble plate 103, which determines the piston stroke, is appropriately maintained by controlling the compressed displacement of the compressor.

In this design, the compressor has the throttle 111 between the crank case 106 and the discharge chamber 110, and both chambers 106 and 110 are interconnected by the passage 112. The refrigerant gas leaking from the discharge chamber 110 into the crank case 106 cannot be completely eliminated. As a result, its cooling ability is decreased and its power loss is increased.

To achieve the foregoing objects, Japanese Unexamined Patent Publication No. 62-191673 discloses a conventional compressor. As illustrated in FIG. 9, the compressor has a switch valve 117 which selects an appropriate passage between a first and second passages 114 and 115, which interconnect the crank case 106 and the suction chamber 107, respectively, as well as between a third passage 116 which interconnects the crank case 106 and the discharge chamber 110, for closing the selected passage. The switch valve 117 is caused to switch based on the force corresponding to the pressure in the discharge chamber 110 and the suction chamber 107.

When the internal pressure Pd in the discharge chamber 110 is higher than the predetermined value (the value is set based on a normal operation of the compressor with normal load), the switch valve 117 is shifted to close the second and third passages 115 and 116. Therefore, even when the compressor is operated under maximum compression displacement, the pressure leakage from the discharge chamber 107 into the crank case 106 is prevented by the third passage 116, which is provided in the crank case 106. Thus, if the internal pressure in the suction chamber 107 were caused to drop below the predetermined value, a switch valve 117, which is disposed in the first passage 114, is activated to close the first passage 114. When the internal pressure in the suction chamber 107 is higher than the predetermined value, the switch valve 117 is activated to open the first passage 114, so as to maintain the appropriate internal pressure Ps in the crank case 106.

When the internal pressure Pd in the discharge chamber 110 is smaller than the predetermined value (the compressor is operated under low load), the switch valve 117 is shifted to close the first passage 114, and to open the second and third passages 115 and 116. A throttle 118 is disposed in the second passage 115. The throttle 118 causes the pressure in the crank case 106 through the suction chamber 107 and the second passage 115, to be lower than that in the discharge chamber 110 through the crank case 106 and the third passage 116. The inclination angle of the wobble plate 103 is shifted by the predetermined value in order to prevent the compression displacement to be deceased.

In the compressor described above, the objective is to keep the internal pressure generally constant in the crank case 106, when the compressor is operated at the maximum displacement. Therefore, when the internal pressure in the discharge chamber 110 is increased beyond the predetermined value, the third passage 116 is caused to close temporarily. As a result, the discharge chamber 110 and the crank case 106 are isolated from each other even if the compressor were not operated at the maximum displacement. The increase of the internal pressure in the crank case 106 is based on the blow-by gas, alone. This causes the response time for decreasing the magnitude of the inclination angle of the wobble plate 103 to be lowered.

SUMMARY OF THE INVENTION

Accordingly, it is a primary object of the present invention to provide a variable displacement compressor which precisely controls the compression displacement.

Another object of the present invention to provide a variable displacement compressor which causes the inclination angle of the wobble plate to be rapidly varied, while maintaining a good response ability.

To achieve the foregoing and other objects and in accordance with the pressure of the present invention, an improved a variable displacement compressor is provided. The variable displacement compressor includes a suction chamber for receiving refrigerant gas, and a plurality of reciprocating pistons for compressing the refrigerant gas supplied form the suction chamber within corresponding bores. The compressor further includes a tiltable wobble plate for adjusting the piston stroke in accordance with the tilt angle, a crank case for adjusting the tilt angle of the wobble plate in accordance with the difference between the inner pressures in the suction chamber and the crank case, a discharge chamber for discharging the compressed refrigerant gas, a first passage for connecting the suction chamber to the crank case, said first passage transferring the pressure of the crank case to the suction chamber and a second passage for connecting the crank case to the discharge chamber and having a restriction, said second passage transferring the pressure of the discharge chamber to the crank case.

BRIEF DESCRIPTION OF THE DRAWINGS

The features of the present invention that are believed to be novel are set forth with particularity in the appended claims. The invention, together objects and advantages thereof, may best be understood by reference to the following description of the presently preferred embodiments taken in conjunction with the accompanying drawings in which:

FIGS. 2 and 3 are enlarged cross-sectional views of details of a passage structure taken from FIG. 1, wherein FIG. 2 shows a valve opening the passage and FIG. 3 shows the valve closing the passage;

DETAILED DESCRIPTION OF THE PREFERRED EMBODIMENT

The preferred embodiment of the present invention will now be described in greater detail, with reference to FIGS. 1 through 6.

Figure 1:
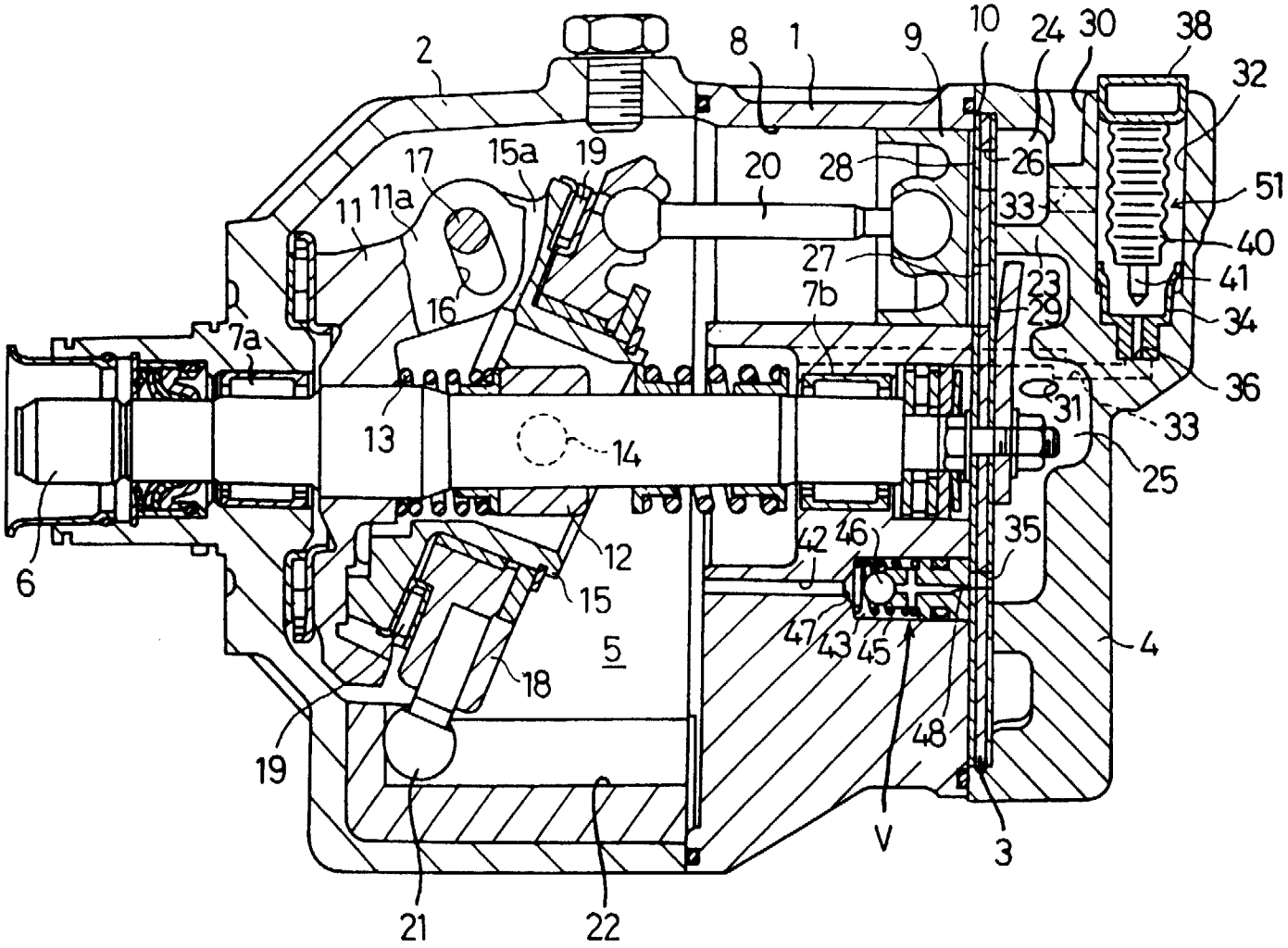
FIG. 1 is a cross-sectional view showing a compressor according to the present invention.

As illustrated in FIG. 1, a front housing 2 is connected to the front end of a cylinder block 1, and a rear housing 4 is connected to the rear end of the cylinder block 1, via a valve plate 3 interposed therebetween. A drive shaft 6 is accommodated in a crank case 5, defined in the front housing 2. The drive shaft 6 is rotatably supported by a pair of radial bearings **7*a* and 7*b*. The cylinder block 1 has a plurality of cylinder bores 8 (only one of the bores is illustrated) arranged around the radial bearing 7*b*. The cylinder bores 8 are connected to a crank case 5. A piston 9 is slidably fitted in each one of the cylinder bores 8. A compression chamber 10 is defined by between the piston 9 and valve plate 3**.

A drive plate 11 is supported on the drive shaft 6, in the crank case 5, in such a way that it can be rotated integrally with the drive shaft 6. Furthermore, a sleeve 12 is slidably secured to the drive shaft 6. A compression spring 13 is interposed between the drive plate 11 and the sleeve 12, for urging the sleeve 12 toward the rear housing 4.

A rotary journal 15 is supported on the sleeve 12, via a pair of right and left link pins 14, in such a way that it can be rocked or swung. The rotary journal 15 has an annular shape, and surrounds the drive shaft 6. The rotary journal 15 has a bracket **15*a* protruding on the side of the drive shaft 6. The drive plate 11 has a support arm 11*a* which protrudes on the side of the drive shaft 6. An elongated hole 16 is formed in the supporting arm 11*a*. A guide pin 17 is formed at the distal end portion of the bracket 15*a*, which is slidably guided along the elongated hole 16. The engagement of the elongated hole 16 with the guide pin 17 allows the rotary journal 15 to rock forward and backward, and to integrally rotate with the drive shaft 6 and the drive plate 11**.

A wobble plate 18 is mounted on the circumference of the rotary journal 15, via a thrust bearing 19, and surrounds the drive shaft 6. The wobble plate 18 is operatively connected to the corresponding piston 9, which is positioned in the circumferential direction, via a plurality of connecting rods 20, which are equidistantly disposed. The wobble plate 18 has a stopper 21 having a ball-shape, for preventing the integral rotational movement of the wobble plate 18. The stopper 21 is slidably fitted in a slide groove 22 which is formed in the inner wall of the crank case 5. Therefore, the wobble plate 18 can be rocked forward and backward, without rotational movement, with respect to the rotational movement of the drive shaft 6 and the rotary journal 15. Each one of the pistons 9 is caused to linearly reciprocate within the associating bore 8, via the forward and backward movement of the wobble plate 18.

The inside of the rear housing 4 is divided into a suction chamber 24 and a discharge chamber 25 by a partition wall 23. The valve plate 3 has a plurality of inlet ports 26 and discharge ports 27 formed in the respective cylinder bores 8. Each compression chamber 10 communicates with the suction chamber 24 or the discharge chamber 25, through the corresponding inlet port 26 or the discharge port 27, respectively. Each inlet port 26 and discharge port 27 is blocked by an inlet valve 28 and a discharge valve 29. While the piston 9 is in the suction process, the inlet valve 28 is caused to open, and the discharge valve 29 to close. While the piston 9 is in the discharge process, the inlet valve 28 is caused to close, and the discharge valve 29 to open, respectively. Each suction chamber 24 and discharge chamber 25 has a suction port 30 and a discharge port 31. The compressor is connected to the refrigerant circuit (not shown) of a cooling mechanism, through these foregoing members.

A valve holding chamber 32 is formed in such a way that the outer wall of the rear housing 4 is expanded, and is located in a passage 33, which interconnects the crank case 5 with the suction chamber 24. An automatic control valve 51 for controlling the displacement is accommodated within the holding chamber 32.

A coupling 34 is fitted within the holding chamber 32 at the side close to the crank case. A small bore 36 is formed in the coupling 34, for causing the holding chamber 32 to communicate with the crank case 5. Bellows 40 is secured on the base 38 for closing the holding chamber 32. A gas having a predetermined pressure is sealed within the bellows 40. The bellows 40 is expanded or contracted based on the pressure difference corresponding to the gas pressure in the bellows 40 and that of the holding chamber 32. A needle 41 is provided at the distal end of the bellows 40. The needle 41 is inserted into, or extracted from the small bore 36, due to the expansion or contraction movement of the bellows 40, respectively. The pressure Pc in the crank case 5 is controlled in such a way that the crank case 5 is caused to be connected to or disconnected from the suction chamber 24, based on the opening or closing movement of the needle 41 with respect to the small bore 36.

Figure 2:
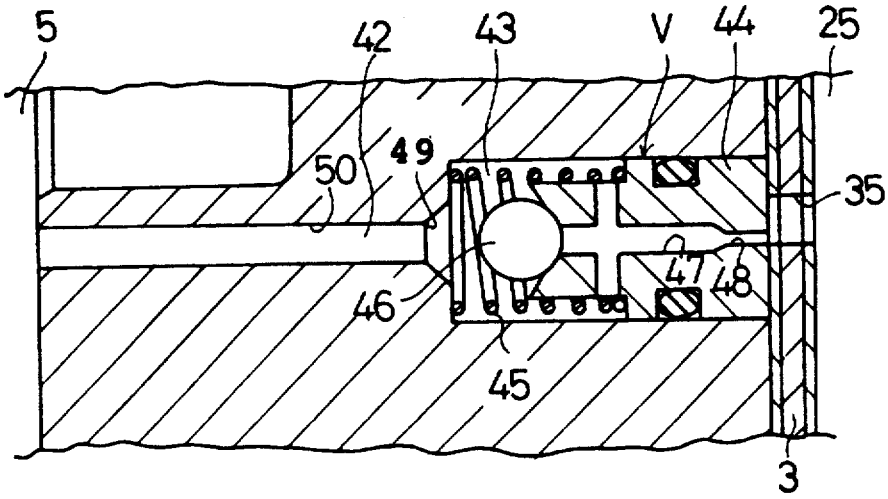
Figure 3:
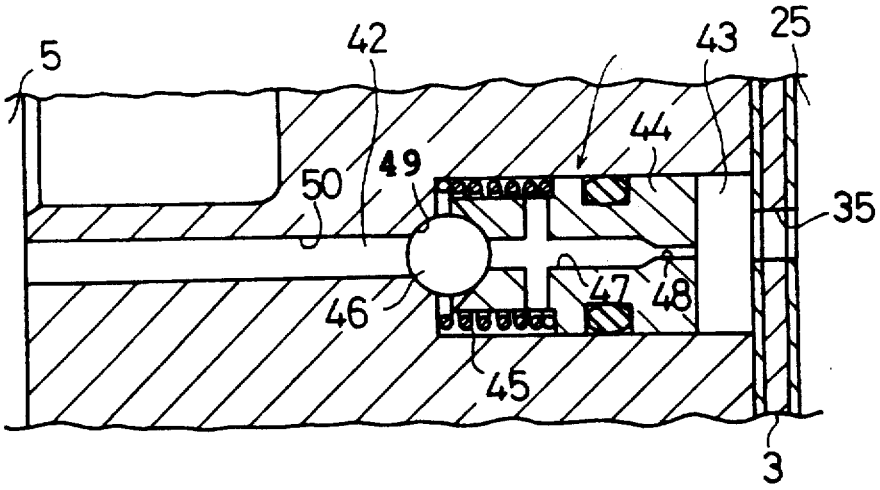

A passage 42 is formed between the cylinder block 1 and an opening 35 of the valve plate 3, and interconnects the discharge chamber 25 and the crank case 5. As illustrated in FIGS. 2 and 3, the passage 42 includes a communication passage 50 and a valve chamber 43, the latter being formed in the vicinity of the valve plate 3, which connects the crank case 5 and the valve plate 3. A spool 44 is used as a control valve V, and is disposed in the valve chamber 43, which is urged against the valve plate 3, via the urging force of a compression spring 45. A passage 47 is formed in the spool 44 for connecting the opening 35 and the valve chamber 43. A throttle 48 is accommodated at the valve plate side of the passage 47. A closing member 46 having a ball-shape is provided at the front end of the spool 44. The closing member 46 is fitted into, or retreated from a recess 49, which has a tapered surface opened toward the passage 50.

The pressure Pd in the discharge chamber 25 acts on the rear end surface of the spool 44, through the opening 35. The pressure Pc in the crank case 5 acts on the front end surface of the spool 44, through the passage 42. While the compressor is operated at the maximum discharge displacement, the maximum discharge pressure Pdmax which is generated in the discharge chamber 25 is set to satisfy the following equation, $Pdmax > Pc + Pp$, by adjusting the urging force Pp of the compression spring 45. Therefore, the spool 44 is caused to close, when the compressor is operated at the maximum displacement.

As illustrated in FIG. 2, the spool 44 is in the open position when the compressor is operated at near the maximum displacement, under the high load but does not reach the maximum displacement. Thus, the following equation, $Pd < Pc + Pp$, is always satisfied. When the spool 44 is caused to open, the refrigerant gas in the discharge chamber 25 is discharged from the opening 35 into the crank case 5, through the passage 47 of the spool 44, the valve chamber 43 and the communication passage 50, respectively.

As a result, the internal pressure in the crank case 5 is caused to increase. The rapid flow of the refrigerant gas from the discharge chamber 25 to the crank case 5, and the rapid internal pressure increase in the crank case 5 and the rapid internal pressure decrease in the discharge chamber 25 are prevented by the throttle 48 in the passage 47. The compression displacement is smoothly varied to obtain the steady operation of the compressor.

While the compressor is operated at the maximum displacement, the wobble plate 18 is caused to rock forward and backward in relation to the rotary movement of the drive shaft 6. The refrigerant gas is compressed by the reciprocating movement of the piston 9 within the cylinder bore 8. The pressure Pc in the crank case 5 is controlled by the automatic control valve 51. The inclination angle of the wobble plate 18 is varied according to the difference between the pressure Pc in the crank case 5, and the pressure Ps in the suction chamber 24, in order to control the compression displacement. The spool 44 is caused to open within the valve chamber 43 accommodated in the passage 42. The refrigerant gas is caused to rapidly flow into the crank case 5 from the discharge chamber 25, so as to decrease the inclination angle of the wobble plate 18.

When the compressor is operated at the maximum displacement, as illustrated in FIG. 3, the spool 44 within the valve chamber 43 in the passage 42 is caused to close. Therefore, the refrigerant gas does not flow from the discharge chamber 25 to the crank case 5. As a result, the compressor is operated reliably without losing its cooling ability and power.

Figure 4:
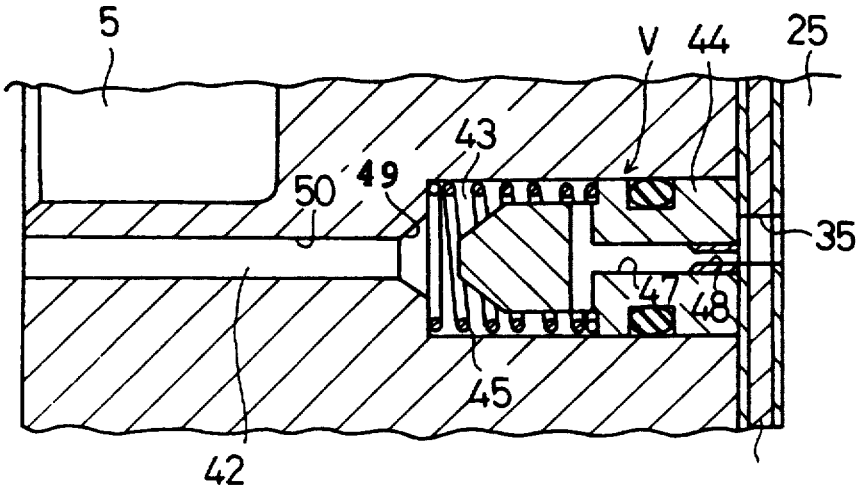
FIGS. 4 through 6 are fragmentary cross sections showing modifications of the present invention, respectively.
Figure 5:
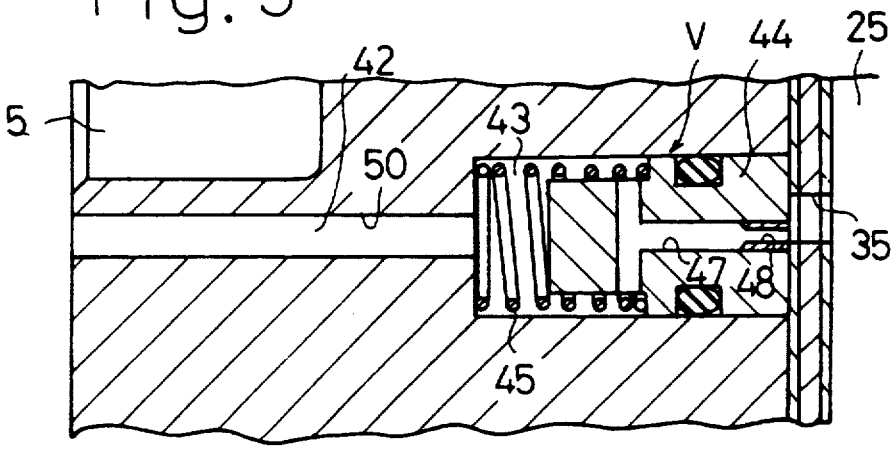

Although only one embodiment of the present invention has been described herein, it should be apparent to those skilled in the art that the present invention may be embodied in many other specific form without departing from the scope of the invention. Particularly, it should be understood that the spool structure described above could also be changed. FIGS. 4 and 5 illustrate another embodiment according to the present invention. In this embodiment, the closing member 46 of the spool 44 is replaced by a differently shaped spool 44, such that the distal end surface at the closing side of the spool 44 is tapered to a point or has a straight vertical wall. The recess 49 has a shape which corresponds to the newly formed spool 44. Therefore, the closing member 46 can be eliminated. As a result, the manufacturing process is simplified, and the manufacturing cost reduced.

Figure 6:
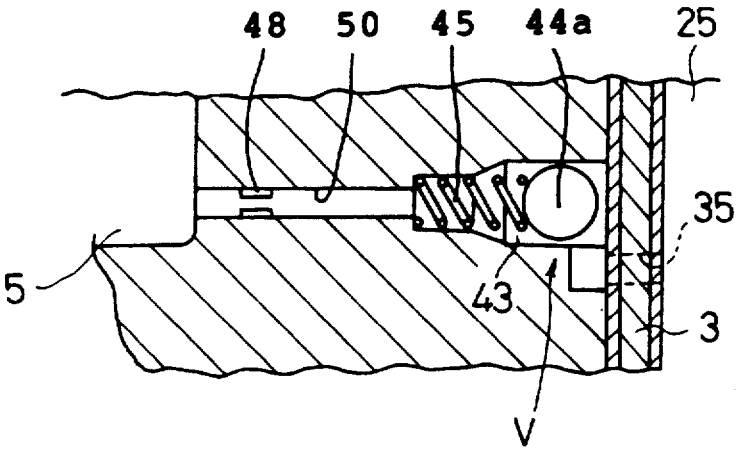
Figure 7:
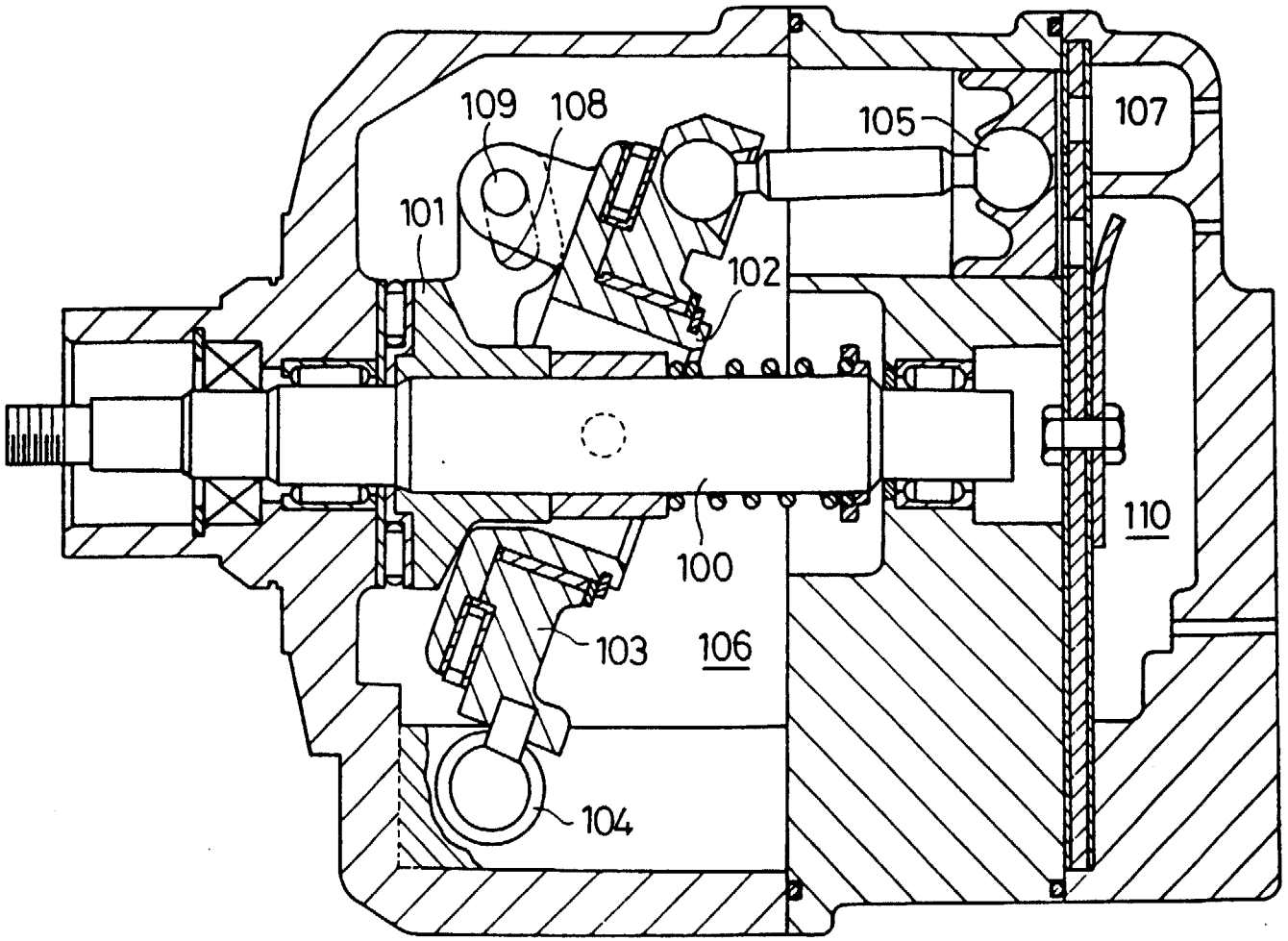
Fig. 7 PRIOR ART
FIG. 7 is a cross-sectional view illustrating a conventional compressor.
Figure 8:
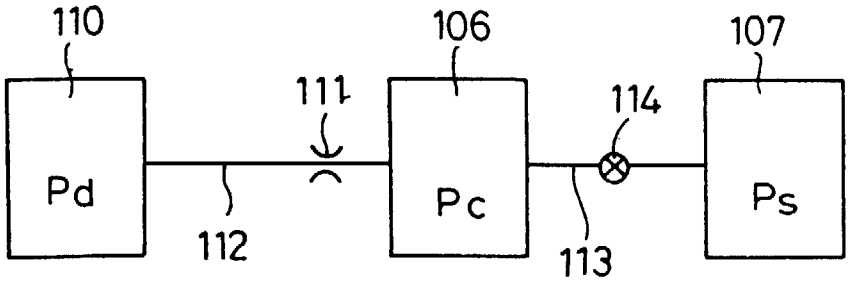
Fig. 8 PRIOR ART
FIG. 8 is a schematic view showing pressure transmitting passages in the conventional compressor.
Figure 9:
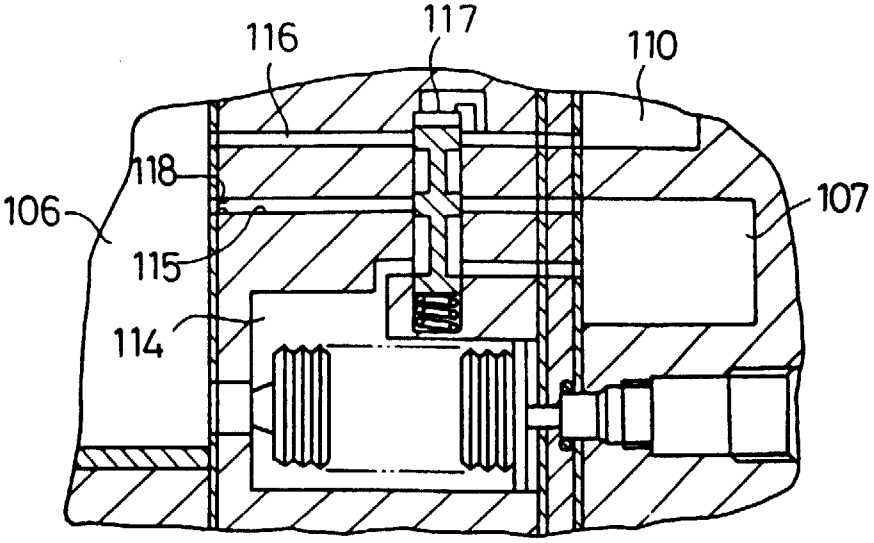
Fig. 9 PRIOR ART
FIG. 9 is a schematic view showing pressure transmitting passages in another conventional compressor.

FIG. 6 illustrates another embodiment, in which a control valve V consists only of a spool 44*a* having a ball-shape. When the pressure Pd in the discharge chamber 25 exceeds the predetermined value, the spool 44*a* is caused to move toward the closing direction, against the urging force of the coil spring 45. When the spool 44*a* is in the opening position, the refrigerant gas in the discharge chamber 25, whose flow is controlled by the throttle 48 in the passage 50, is fed into the crank case 5.

The control of the compression displacement in this embodiment is less effective than that of other embodiments. For example, as the throttle 48 is formed in the passage 50, the pressure Pd in the discharge chamber 25, and the pressure on the spool 44*a* side through the throttle 48 of the passage 50, act on the spool 44*a* of the control valve V. Therefore, the pressure Pc in the crank case 5, which controls the inclination angle of the wobble plate 18 is not precisely reflected.

On the other hand, when the throttle 48 which is essential for preventing the rapid pressure drop in the discharge chamber 25 and the crank case 5 is accommodated within the passage 47 of the spool 44, the pressures Pc and Pd in the crank case 5 and the discharge chamber 25 acting on the end surfaces of the spool 44 are not effected by the throttle 48. As a result, the operation for opening or closing the passage 42 is controlled based on the pressure Pc, which is directly related to the inclination angle of the wobble plate 18. Consequently, the compression displacement is controlled with high precision.

Therefore, the present examples and embodiments are to be considered as illustrative and not restrictive, and the invention is not to be limited to the details given herein.

What is claimed is:

1. A variable displacement compressor including a suction chamber for receiving refrigerant gas, and a plurality of reciprocating pistons for compressing the refrigerant gas supplied from said suction chamber within corresponding bores, the compressor comprising:

a tiltable wobble plate for adjusting the piston stroke in accordance with the tilt angle;

a crank case enclosing the wobble plate providing for adjustment of the tilt angle of the wobble plate in accordance with the difference between the inner pressures in said suction chamber and said crank case;

a discharge chamber for discharging said compressed refrigerant gas;

a first passage for connecting the suction chamber to the crank case, said first passage transferring the pressure of the crank case to the suction chamber;

a second passage for connecting the crank case to the discharge chamber and having a restriction, said second passage transferring the pressure of the discharge chamber to the crank case;

a pressure adjusting valve provided along said first passage, for transferring the pressure in said crank case to said suction chamber in order to control the inner pressure in said crank case as a function of the pressure within said suction chamber;

control valve means provided along said second passage for controlling the connection of said crank case to said discharge chamber in accordance with the difference between the inner pressures in said discharge chamber and said crank case, said control valve means being constructed such that said second passage is closed to fluid flow when said difference in pressure is in excess of a predetermined value, and said second passage is opened to fluid flow when said difference in pressure is lower than said predetermined value;

and means for isolating said crank case from said discharge chamber barring fluid flow directly therebetween when said second passage is closed to fluid flow.

2. A variable displacement compressor according to claim 1, wherein said control valve means includes an inner passage for transferring the pressure of said discharge chamber to the side of said crank case.

3. A variable displacement compressor according to claim 2, wherein said restriction is formed along said inner passage of said control valve means.

4. A variable displacement compressor according to claim 1 further comprising;

a rotary shaft; and support means, mounted on the rotary shaft for integral rotation, and for supporting the wobble plate for the relative rotation and integral tilting movement.

5. A variable displacement compressor according yo claim 4, wherein the support means includes;

a drive plate secured on the rotary shaft;

a slide member slidably supported on the rotary shaft; and a rotary journal swingably connected to the slide member and integrally tiltably and integrally rotatable connected to the drive plate for supporting the wobble plate for the relative rotating movement.

6. A variable displacement compressor according to claim 5, wherein the wobble plate includes a stopper engaged with a groove formed with the inner wall of the crank case so as to prevent the rotation of the wobble plate following that of the rotary journal.

7. A compressor according to claim 1, wherein said control valve means comprises a valve piece slidable within said second passage, said valve piece having at one end an obturating structure for contacting a valve seat within said second passage to completely said discharge chamber from said crank case, and a spring for urging said valve piece away from said valve seat against the pressure in said discharge chamber.

8. A compressor according to claim 7, wherein said predetermined value is determined by adjusting the bias of said spring.

9. A compressor according to claim 1, wherein said predetermined value is the difference between the pressure in said crank case and is said discharge chamber, when said pressure in said discharge chamber is the maximum when the compressor is operated at the maximum displacement.

10. A variable displacement compressor including a suction chamber for receiving refrigerant gas, and a plurality of reciprocating pistons pistons for compressing the refrigerant gas supplied from said suction chamber within corresponding bores, the compressor comprising:

a tiltable wobble plate for adjusting the piston stroke in accordance with the tilt angle;

a crank case for enclosing the wobble plate providing for adjustment of the tilt angle of the wobble plate in accordance with the magnitude of the inner pressure in the crank case; said tilt angle being increased in inverse relation to the magnitude of the pressure within said crank case;

a discharge chamber for discharging said compressed refrigerant gas;

a first passage for connecting the suction chamber to the crank case, said first passage transferring the pressure of the crank case to the suction chamber;

a second passage for connecting said crank case to the discharge chamber and having a restriction, said second passage transferring the pressure of the discharge chamber to the crank case;

a pressure adjusting valve provided along said first passage, for transferring the pressure in said crank case to said suction chamber in order to control the inner pressure in said crank case as a function of the pressure within said suction chamber;

control valve means provided along said second passage for controlling the connection of said crank case to said discharge chamber in accordance with the difference between the inner pressures in said discharge chamber and said crank case, said control valve means including means for closing said second passage to fluid flow when said difference in pressure is in excess of a predetermined value, and for opening said second passage to fluid flow when said difference in pressure is lower than said predetermined value;

and means for isolating said crank case from said discharge chamber barring fluid flow directly therebetween when said second passage is closed to fluid flow.

11. A variable displacement compressor according to claim 10, wherein said control valve includes an inner passage for transferring the pressure of the discharge chamber to the side of the crank case.

12. A variable displacement compressor according to claim 11, wherein said restriction is formed along said inner passage of the control valve means.

13. A variable displacement compressor according to claim 9 further comprising;

a rotary shaft; and support means, mounted on the rotary shaft for integral rotation, and for supporting the wobble plate for the relative rotation and integral tilting movement.

14. A variable displacement compressor according to claim 13, wherein the support means includes;

a drive secured on the rotary shaft;

a slide member slidably supported on the rotary shaft; and a rotary journal swingably connected to the slide member and integrally tiltably and integrally rotatably connected to the drive plate for supporting the wobble plate for the relative rotating movement.

15. A variable displacement compressor according to claim 14, wherein the wobble plate includes a stopper engaged with a groove formed with the inner wall of the crank case so as to prevent the rotation of the wobble plate following that of the rotary journal.

16. A compressor according to claim 10, wherein said control valve means comprises a valve piece slidable within said second passage, said valve piece having at one end an obdurating structure for contacting a valve seat within said second passage to completely said discharge chamber from said crank case, and a spring for urging said valve piece away from said valve seat against the pressure in said discharge chamber.

* * * * *

UNITED STATES PATENT AND TRADEMARK OFFICE

CERTIFICATE OF CORRECTION

PATENT NO. : 5,318,410
DATED : June 7, 1994
INVENTOR(S) : Kawamura et al

It is certified that error appears in the above-indentified patent and that said Letters Patent is hereby corrected as shown below:

Column 6, line 43, start new paragraph at "Figs. 4".

Column 8, line 11, change "yo" to --to--; line 19 "able" should read "ably"; line 30, after "completely" insert --disconnect--; line 39, "is" should read --in--; line 45 delete "pistons" (second occurrence).

Column 9, line 25, "claim 9" should read --claim 10--.

Column 10, line 7, after "drive" insert --plate--; line 23, after "completely" insert --disconnect--.

Signed and Sealed this

Eleventh Day of October, 1994

*Attest:*

Bruce Lehman

BRUCE LEHMAN

*Attesting Officer*

*Commissioner of Patents and Trademarks*